United States Patent [19]

Gygax

[11] Patent Number: 4,523,856

[45] Date of Patent: Jun. 18, 1985

[54] ELECTRONIC TIMEPIECE INCLUDING AN ELECTRO-ACOUSTIC TRANSDUCER

[75] Inventor: Claude-André Gygax, Evilard, Switzerland

[73] Assignee: Societe Suisse pour l'Industrie Horlogere Management Services, Bienne, Switzerland

[21] Appl. No.: 269,932

[22] Filed: May 29, 1981

[30] Foreign Application Priority Data

Jun. 4, 1980 [FR] France ..... 80 12715

[51] Int. Cl.[3] ..... G04B 23/02

[52] U.S. Cl. ..... 368/72; 368/250; 368/251; 368/255; 368/256

[58] Field of Search ..... 368/250, 251, 255, 256, 368/72, 73, 75, 296; 340/384 E

[56] References Cited

U.S. PATENT DOCUMENTS

| | | | |
|---|---|---|---|
| 3,733,804 | 5/1973 | Diersbock | 368/255 |
| 3,747,327 | 7/1973 | Uchiyama | 58/23 R |
| 3,788,060 | 6/1974 | Kawamura | 368/255 |
| 3,871,170 | 3/1975 | Bergey | 368/69 |
| 3,905,666 | 9/1975 | Grimm et al. | 339/17 R |
| 3,983,690 | 10/1976 | McClintock | 368/69 |
| 4,068,461 | 1/1978 | Fassett et al. | 368/255 X |

FOREIGN PATENT DOCUMENTS

| | | | |
|---|---|---|---|
| 47901 | 6/1979 | Japan | 368/255 |
| 4642/72 | 3/1976 | Switzerland . | |
| 1172546 | 3/1969 | United Kingdom . | |
| 2032146 | 4/1980 | United Kingdom . | |

OTHER PUBLICATIONS

Patent Abstracts of Japan, vol. 3, No. 82, Jul. 14, 1979, PG 22E123, Kokai No. 54-59968.

*Primary Examiner*—Ulysses Weldon

*Attorney, Agent, or Firm*—Griffin, Branigan & Butler

[57] ABSTRACT

An electronic timepiece is provided with an alarm and means coupling a sounding unit to a circuit generating a sonic signal. The first electrode (6) of the sounding unit (5) is mechanically and electrically fixed to a metallized decoration (4) set under the glass (3). Two conductive members (12) are arranged to pass through the timepiece dial and then to be elastically supported, the first against the decoration (4) and the second against the second electrode (7) of the sounding unit in order to connect said unit to the terminals (10) of the signal generating circuit. The arrangement facilitates encasing the timepiece and thus realizes an increased productivity.

3 Claims, 2 Drawing Figures

ELECTRONIC TIMEPIECE INCLUDING AN ELECTRO-ACOUSTIC TRANSDUCER

BACKGROUND OF THE INVENTION

This invention concerns a timepiece having at least an analog display means in which the hands are located between a dial and a crystal, the latter bearing on its inner surface a metallized decoration, partially extending thereover in order to support an electro-acoustic transducer, and to assure an electrical connection with a first electrode of said transducer. A printed circuit located within a timepiece movement provides an electronic control means and output terminals for an electric signal at an acoustic frequency and electrical couplings comprising two conductive leads are arranged so that the first thereof contacts said metallized decoration and the second thereof contacts a second electrode of said transducer.

Timepieces are known in which the alarm arrangement takes the form of an electro-acoustic transducer operatively associated with the watch crystal. Generally this may take the form of a piezoelectric pellet glued onto the internal surface of the crystal and which receives an acoustic frequency signal coming from the watch electronics. For example the Japanese Utility Model No. 1 223 023 describes an electric alarm clock which includes a piezoelectric slab fixed to the internal surface of the crystal. The slab oscillates at an audible frequency in view of the signal emitted by a circuit disposed within the case. The slab in turn excites the crystal into vibration. In the document cited the slab is found in the centre of the crystal and its connection to the internal circuit is realised by means of two wires which initially traverse the crystal then penetrate to the interior of the watch by a hole arranged at the periphery of the dial.

It can be foreseen that this type of construction may cause difficulties for the encasing of the timepiece. Effectively after having mounted the dial and set the hands in place it becomes necessary to connect the slab to the feed wires by means of soldering or by conductive glue, this requiring specially trained personnel.

The present invention overcomes this difficulty by proposing an arrangement wherein soldering or use of conductive glue is avoided in connecting the slab to its feed source, thereby greatly facilitating the encasing of the watch.

A watch similar to the generic definition given hereinabove is described in Japanese Patent Specification No. 54-59 968. However, in this case the disclosure concerns a digital display thus not providing a dial interposed between the module and the watch crystal, and wherein the problem does not exist of having to add contact blades to electric leads following assembly of the dial onto the movement as described hereinafter.

This invention thus has as its purpose to provide in a timepiece having a mechanical analog display, connection means between the electronic module and the electro-acoustic transducer, such means being defined by the claims.

DETAILED DESCRIPTION OF THE DRAWINGS

Figure 1:
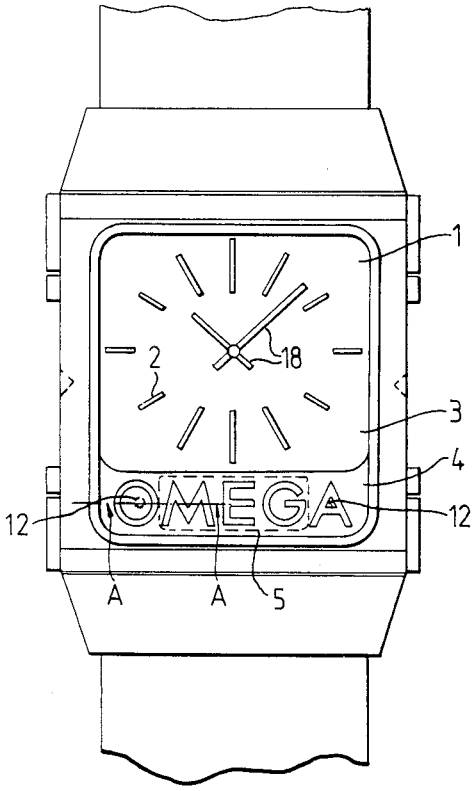
FIG. 1 is a plan view of the timepiece.

FIG. 1 shows a timepiece having an analog display and provided with hands 18. Dial 1 bears hour indicators 2 and appears through a crystal 3. The dial is partly masked by a decoration 4 which is fixed onto the internal face of the crystal. Under this decoration appears in dotted lines a piezoelectric transducer 5, and studs 12 which will be discussed further on.

Figure 2:
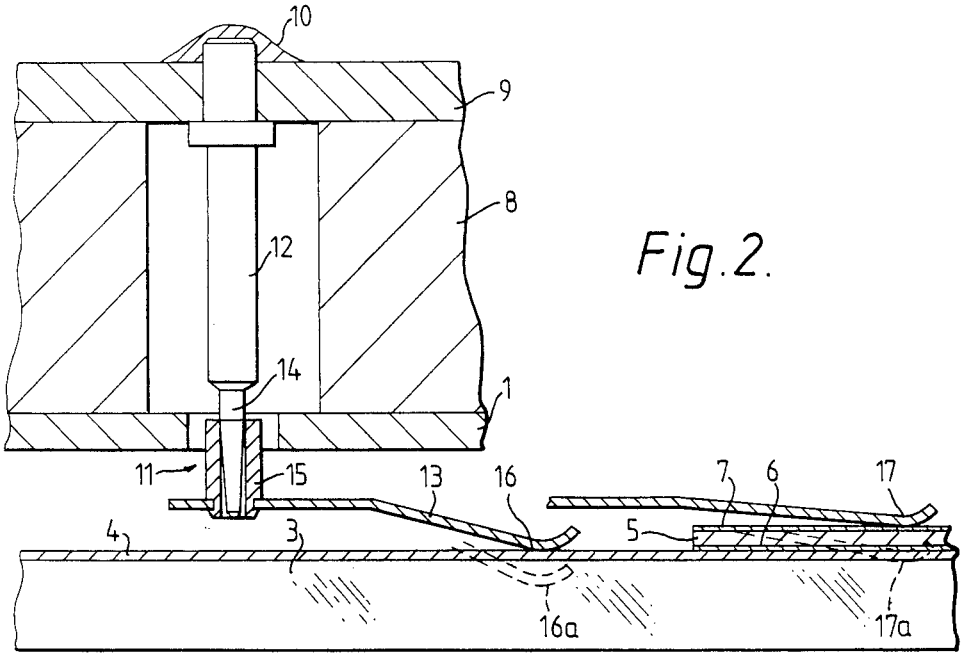
FIG. 2, is a cross section to an enlarged scale along line A—A of FIG. 1.

FIG. 2 is a section along line A—A of FIG. 1 showing the same elements. Crystal 3 is coated on its internal face with a decoration 4 which covers it partially and which has the property of being electrically conductive. Transducer 5 is a piezoelectric pellet which is provided with electrodes 6 and 7 on each of its surfaces respectively. According to the invention the first electrode 6 is applied directly onto the metallized decoration and is fixed thereto by means of glue for instance. One thus obtains mechanical and electrical coupling between electrode 6 and metallized decoration 4. The drawing shows further the dial 1, the movement 8 and the printed circuit 9 which includes in addition to the electronic elements the output terminals, of which a single one 10 is shown, for an acoustic signal. According to the invention the electrical connection between the output terminal 10 and the metallized decoration 4 is brought about by means of a conductive lead 11 of which one of the ends is supported on the decoration 4. A coupling between the output terminal which has not been shown (this being found in a different plane) and the second electrode 7 of the pellet 5 is obtained in the same manner by a conductive lead for which one only of the support ends is shown. These leads are situated under the decoration 4 and are thus not visible from the exterior of the timepiece.

According to a preferred form of the invention, each of the conductive leads comprises the assembly of a stud 12 and of a blade 13. At one side the stud is soldered onto the printed circuit at its terminal 10 and at the other side it is profile turned at 14 in a manner identical to that normally employed for the stem which receives a seconds hand. Blade 13 which preferably is obtained from a gilded beryllium bronze is rivetted at one end onto a tube 15 adjusted to a friction fit over the profile 14 and is supported at its other extremity 16 by the metallized decoration 4. The other conductive lead is obtained in the same manner and the only portion appearing on the drawing is that of the second extremity 17 of its blade which is supported on the second electrode 7 of the piezoelectric pellet 5. At 16*a* and 17*a* have been indicated the positions which the blades 16 and 17 take before they are supported, the first on decoration 4 and the second on electrode 7 respectively.

It will be readily appreciated that the construction which has just been described presents at least two important advantages.

At the time of the assembly of the watch and as soon as the dial 1 has been placed the contact blades are assembled by insertion of tube 15 onto the profile turning 14 at the same time as one assembles the hands of the watch. In this manner when the movement is placed into its case the spring blades are brought into contact with the electrodes of the piezoelectric pellet. Accordingly the casing operation may be given to non-specialized personnel and moreover time will be gained.

FIG. 2 shows that the printed circuit 9 is relatively remote from the piezoelectric pellet 5 and that the point of contact of blade 17 with electrode 7 is not superposed on the output terminal (not shown) for the acoustic frequency signal situated on the printed circuit 9. As may be seen, the preferred realisation of the invention enables one to assure contact between widely separated points (through edjustment of the length of the stud) and with eccentrically arranged points (through adjusting the length of the spring blade).

Finally it will be mentioned that in order to realise a good mechanical coupling between transducer 5 and crystal 3, the glue film will be very thin, thereby permitting likewise an electrical capacitive coupling between the metallized decoration 4 and the electrode 6. The utilisation of a conductive glue on at least a portion of electrode 6 is equally possible thereby obtaining a galvanic coupling with the metallized decoration 4. What I claim is:

1. An electronic timepiece comprising at least an analog display means in which the hands are located between a dial and a crystal, a metallized decoration seen from outside the crystal mounted on the inner surface thereof for partially extending thereover, an electro-acoustic transducer supported by the metallized decoration and having at least a first electrode attached to said metallized decoration to assure an electrical connection with said first electrode of said transducer, a printed circuit located within the timepiece movement providing electronic control means and having output terminals for providing an electric signal at an acoustic frequency, two conductive leads arranged so that the first thereof contacts said metallized decoration and the second thereof contacts a second electrode of said transducer wherein each of said conductive leads comprises a stud arranged to traverse the dial in a region lying under the decoration, a first end of each of said studs being fixed to a respective output terminal and the second end adapted to receive, following assembly of the dial onto the timepiece, a spring blade, at least two of said spring blades for effecting an electrical contact in the case of said first stud with said decoration and in the case of said second stud with said second electrode following introduction of the timepiece movement into the case bearing the crystal.

2. An electronic timepiece as set forth in claim 1 wherein said spring blade is rivetted onto a tube adjusted to a friction fit onto the second end of the stud.

3. An electronic timepiece as set forth in claim 1 wherein said spring blade is formed of gilded beryllium bronze.

* * * * *